US008594551B2

(12) United States Patent
Nonaka et al.

(10) Patent No.: US 8,594,551 B2
(45) Date of Patent: Nov. 26, 2013

(54) FIXING DEVICE AND IMAGE FORMING APPARATUS

(75) Inventors: Manabu Nonaka, Kanagawa (JP); Hidehiko Fujiwara, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 953 days.

(21) Appl. No.: 12/256,121

(22) Filed: Oct. 22, 2008

(65) Prior Publication Data

US 2009/0116884 A1 May 7, 2009

(30) Foreign Application Priority Data

Nov. 5, 2007 (JP) ..... 2007-287609

(51) Int. Cl.
*G03G 15/20* (2006.01)

(52) U.S. Cl.
USPC ..... 399/336; 399/122; 399/329

(58) Field of Classification Search
USPC ..... 399/67, 122, 320, 328–331, 335, 336, 399/338; 219/216, 244, 553; 250/493.1, 250/496.1, 503.1, 504 R
See application file for complete search history.

(56) References Cited

U.S. PATENT DOCUMENTS 5,162,634 A * 11/1992 Kusaka et al. ..... 219/216
5,602,635 A * 2/1997 Domoto et al. ..... 399/328
6,151,466 A 11/2000 Fujiwara
6,542,712 B2 4/2003 Kamijo et al.
6,658,222 B2 12/2003 Kamijo et al.
6,731,900 B2 5/2004 Takenaka et al.
6,731,902 B2 5/2004 Takenaka et al.
6,788,916 B2 9/2004 Takenaka et al.
6,801,744 B2 10/2004 Fujiwara et al.
6,907,218 B2 6/2005 Fujiwara et al.
7,013,108 B2 3/2006 Takenaka et al.
2004/0062578 A1* 4/2004 Kim et al. ..... 399/328
2005/0265758 A1* 12/2005 Haseba et al. ..... 399/329
2006/0177251 A1* 8/2006 Uehara et al. ..... 399/329
2008/0124152 A1* 5/2008 Nishikawa et al. ..... 399/336
2008/0199231 A1* 8/2008 Lee et al. ..... 399/329

FOREIGN PATENT DOCUMENTS

JP U59-9370 1/1984
JP 4-122969 4/1992
JP 6-51650 2/1994
JP 7-230795 8/1995
JP 2002-108119 4/2002
JP 2003-005548 1/2003
JP 2003-223064 8/2003
JP 2006-133326 5/2006
JP 2006-324225 11/2006

* cited by examiner

*Primary Examiner* — Walter L Lindsay, Jr.
*Assistant Examiner* — Benjamin Schmitt
(74) *Attorney, Agent, or Firm* — Oblon, Spivak, McClelland, Maier & Neustadt, L.L.P.

(57) ABSTRACT

A fixing device includes a fixing member, a pressing member, a contacting member fixed in an interior of the fixing member, and a heating unit that emits infrared ray. A mechanism concentrates the infrared ray emitted by the heating unit into a nip portion between the fixing member and the pressing member and into an area narrower than a width of the nip portion.

14 Claims, 10 Drawing Sheets

FIXING DEVICE AND IMAGE FORMING APPARATUS

CROSS-REFERENCE TO RELATED APPLICATIONS

The present application claims priority to and incorporates by reference the entire contents of Japanese priority document 2007-287609 filed in Japan on Nov. 5, 2007.

BACKGROUND OF THE INVENTION

1. Field of the Invention

The present invention relates to a technology for fixing an image on a recording medium.

2. Description of the Related Art

Typically, in an image forming apparatus using the electrophotographic system, an electrostatic latent image is first formed on an image carrier, the electrostatic latent image is then developed into a toner image by using toner, the toner image on the image carrier is then transferred onto a recording medium either directly or via an intermediate transfer body. Finally, a fixing device fixes the toner image on the sheet recording medium and discharges the sheet recording medium outside of the image forming apparatus. A copying machine, a printer, a plotter, a facsimile, and a multifunction product are examples of such an image forming apparatus.

Generally, the fixing device applies heat and/or pressure to the toner image on the recording media so that the toner of the toner image fuses and fixes to the recording media. A pair of rollers, a heat roller and a pressing roller, having a nip therebetween is used in typical fixing device. The heat roller is also called as a fixing roller. A heat source, such as a heater, is provided in the interior of the fixing roller. The fixing roller and the pressing roller are in pressure contact with each other. When a recording media with an unfixed toner image thereon passes through the nip between the fixing roller and the pressing roller, heat and/or pressure are applied to the toner of the toner image and the toner fuses and fixes to the recording media.

In a typical fixing roller, an elastic layer and a release layer are laminated on a cylindrical metal core bar. Because the heat capacity of such a fixing roller is relatively high, a longer heating-up time is required. The heating-up time is a time period required to heat the fixing roller from the room temperature to a predetermined higher temperature. A shorter heating-up time is preferable in terms of energy saving. One approach to shorten a starting time is to lower the heat capacity of the fixing roller by using a thinner core bar, or elastic layer.

In the fixing roller, time loss occurs while heat generated by the heater is transferred from the interior of the fixing roller to the surface thereof because a heat source is located inside the fixing roller. In a fixing device used in color image forming apparatuses, it is preferable that the elastic layer is thick enough. Therefore, more time loss occurs in the fixing device used in color image forming apparatuses. Higher time loss leads to various problems. For example, the heating-up time becomes longer. The temperature of the fixing roller is drops when a recording medium passes through the nip between the fixing roller and the pressure roller. It takes longer time to raise the dropped temperature to the original desired temperature. These problems lead to poor fixing.

Various ideas have been proposed to solve these issues. For example, Japanese Patent Application Laid-open No. 2006-324225 discloses a heating device that employs electromagnetic wave. The heating device includes a heat source that emits electromagnetic wave, an aperture area in a heating region through which the electromagnetic wave passes, and a reflecting plate disposed such that the reflecting plate surrounds the heat source. The reflecting plate directs the electromagnetic wave emitted from the heat source toward a to-be-heated object to heat the object. The heating device further includes a heat transport unit that transports heat from the reflecting plate to the object.

Japanese Patent Application Laid-open No. 2003-223064 discloses a fixing device that includes a fixing body and a pressing body that rotate in such a way that the fixing body and the pressing body are pressed to each other and a heat generator that generates heat is arranged in the interior of the fixing body in such a way that the heat generator extends in the direction of the shaft direction of the fixing body. The fixing body and the pressing body press and heat recording material carrying an unfixed image while the fixing body and the pressing body sandwich and convey the recording material and thus the unfixed image is fixed on the recording material. In the fixing device, the fixing body includes a heat resistant base layer that allows infrared ray to transmit, the heat generator that radiates infrared ray by generating heat in the internal space within the base layer, and a reflecting member that reflects the infrared ray radiated from the heat generator in a predetermined direction is provided on a portion of the heat generator.

Japanese Patent Application Laid-open No. 2002-108119 discloses a fixing device that includes a fixing body and a pressing body that rotate in such a way that the fixing body and the pressing body are pressed to each other and a heating unit that heats the fixing body. The fixing body and the pressing body press and heat recording material carrying an unfixed image while the fixing body and the pressing body sandwich and convey the recording material and thus the unfixed image is fixed on the recording material. In the fixing device, the fixing body includes a film in a shape of an endless belt and a guide member that forms a nip portion by being pressed by the pressing body via the film, guides running of the film at the nip portion, and supports the film. The heating unit includes a heat generator that heats the guide member by receiving power from a power supply and a reflecting unit that reflects the heat generated by the heat generator to the side of the guide member away from the nip portion.

Japanese Patent Application Laid-open No. H6-51650 discloses a transfer fixing device for use in an image forming apparatus in which a toner image on a photoconductor drum is transferred to a transfer endless belt, a fixing roller is pressed against the belt, paper is conveyed to a space between the fixing roller and the transfer endless belt, and thus a toner image on the transfer endless belt is transferred to the paper and fixed thereon. In the transfer fixing device, the fixing roller is formed of transparent material, and a heater made up of an infrared lamp and a reflecting plate that concentrates radiation heat generated by the heater on the transfer endless belt is provided in the interior of the fixing roller.

Conventionally, in image forming apparatus such as a copying machine and a printer, fixing devices using an on-demand method are well known in the art. More specifically, fixing devices using the on-demand method are meant for responding to request, for example, that the starting time should be reduced or that a toner image should be properly fixed.

A fixing device using an on-demand method includes, for example, a fixing film (endless film) that is a fixing member, a pressing roller that is a pressing member, and a heater such as a ceramic heater. The heater is disposed inside the loop of the fixing film. The heater contacts the pressing roller via the fixing film, thereby forming a nip portion between the heater and the pressing roller as well as heating the fixing film. The nip portion applies heat and pressure to a toner image on a recording media conveyed to the nip portion, thereby fixing the toner image on the recording media.

The fixing device using the on-demand method includes a fixing film (endless film) that is a fixing member, a pressing roller that is a pressing member, and a heater (heating unit) such as a ceramic heater. The heater is disposed inside the loop of the fixing film. The heater contacts the pressing roller via the fixing film, thereby forming a nip portion between the heater and the pressing roller as well as heating the fixing film. The nip portion provides heat and pressure to a toner image on a recording media conveyed to the nip portion, thereby fixing the toner image on the recording media.

A conventional fixing device using the on-demand method, however, is problematic in that maintainability thereof is poor. More specifically, it is often cumbersome to replace a heating unit such as a heater, as will be described below in detail.

A heater has a finite life. Therefore, in a fixing device, a heater is often replaced with a new one. The heater is, however, in pressure contact with the pressing roller via the fixing film. As a result, it is cumbersome to pull out the heater in the direction of the width direction (longitudinal direction) of the heater, while pressure is applied to the heater.

One approach could be to provide a pressure release mechanism that releases the pressure contact between the heater (fixing film) and the pressing roller. The pressure release mechanism is operated and then the heater can be pulled out from the fixing device. However, this increases the cost and extra space must be prepared for installing the pressure release mechanism.

Specifically in a fixing device using a conventional on-demand method, a pressing member constantly applies pressure to a heater. As a result, the heater is easy to be broken during jam clearance or transportation of fixing devices. Therefore, the problem of poor maintainability cannot be neglected in a conventional fixing device.

SUMMARY OF THE INVENTION

It is an object of the present invention to at least partially solve the problems in the conventional technology.

According to an aspect of the present invention, there is provided a fixing device that fixes an unfixed image formed on a recording media to the recording media by heating the unfixed image at a nip portion. The fixing device includes a fixing member that is flexible; a pressing member that is in pressure contact with the fixing member; a contacting member fixed in an interior of the fixing member, wherein the contacting member is in contact with via the fixing member and the contacting member and the pressing member sandwich the fixing member thereby forming the nip portion; a heating unit that emits infrared ray; and a mechanism that concentrates the infrared ray emitted by the heating unit into the nip portion and into an area narrower than a width of the nip portion.

According to another aspect of the present invention, there is provided an image forming apparatus that includes an image forming unit that forms an unfixed image on a recording media, and the above fixing unit that fixes the unfixed image formed on the recording media to the recording media at a nip portion.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Japanese Patent Application Laid-open No. 2006-324225 discloses a fixing device in which a halogen heater is used as a heating member and a reflecting plate concentrates electromagnetic wave on recording paper as well as a contacting member is not used to form a nip portion in a fixing unit. The present invention as will be described below in greater detail, however, is different from the technology according to Japanese Patent Application Laid-open No. 2006-324225 in that in an aspect of the present invention a reflecting member concentrates infrared ray into an area narrower than a width of a nip and a contact member is used for forming a nip portion.

Japanese Patent Application Laid-open No. 2003-223064 discloses a halogen lamp including a reflecting film that is used as a heating member and a fixing member that allows passage of infrared ray. The present invention as will be described below in greater detail is different from the conventional technology according to Japanese Patent Application Laid-open No. 2003-223064 in that in an aspect of the present invention infrared ray is concentrated into an area having a width of a nip, a reflecting member is located so that the reflecting member does not contact a heating body, and a contacting member is used to form a nip.

Japanese Patent Application Laid-open No. 2002-108119 discloses a halogen lamp including a reflecting film is used as a heating member and a reflecting member that reflects heat generated by the halogen lamp toward a film guide (contacting member) is provided. The present invention as will be described below in greater detail, however, is different from the conventional technology according to Japanese Patent Application Laid-open No. 2002-108119 in that in an aspect of the present invention infrared ray are concentrated into an area having a width of a nip, a reflecting plate includes a slit thereon, and a contacting member is not used.

Japanese Patent Application Laid-open No. H6-51650 discloses an infrared heater and a reflecting plate. The present invention as will be described below in greater detail, however, is different from the conventional technology according to Japanese Patent Application Laid-open No. H6-51650 in that in an aspect of the present invention infrared ray is concentrated into an area having a width of a nip, a reflecting member is located so that the reflecting member does not contact the heating body, and a contact member is used to form a nip portion.

Exemplary embodiments of the present invention are described below in greater detail with reference to the accompanying drawings.

Figure 1:
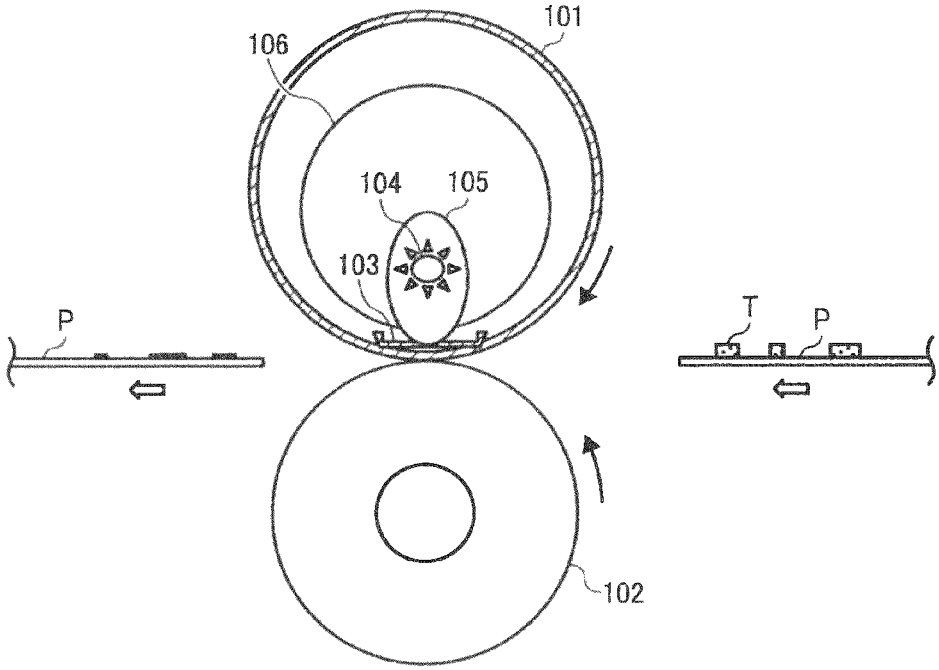
FIG. 1 is a schematic sectional view of a fixing device according to a first embodiment of the present invention.

FIG. 1 is a schematic sectional view of a fixing device according to a first embodiment of the present invention. The fixing device shown in FIG. 1 includes, for example, a fixing film that is a fixing member 101, a heating plate that is a contacting member 103, an infrared heater that is a heating member 104, a heat transfer member 105 that transfers heat generated by the heating member 104 to the contacting member 103, a retaining member 106 that retains the heating member 104 and the heat transfer member 105, and a pressing roller that is a pressing member 102.

The fixing film that is the fixing member 101 is a thin and flexible endless film and rotates in the direction of the arrow shown in FIG. 1 that is the clockwise direction. The fixing film may be formed of, for example, polyimide, polyamide, fluororesin, or metal. To ensure releasability of toner (toner image) T from the fixing film, a release layer formed of, for example, PFA (tetrafluoroethelene-perfluoroalkylvinylether copolymer resin), polyimide, polyetherimide, or PES that is polyether sulfide may be formed on the surface of the fixing film. By using a fixing film having a low heat capacity as the fixing member 101, a fixing device using an on-demand method of which a starting time is short can be provided.

For example, the heating member 104, the contacting member 103, the heat transfer member 105, and the retaining member 106 are arranged inside the loop of the fixing member 101. The heating plate that is the contacting member 103 applies pressure on the fixing film 101, thereby forming a nip portion between the fixing film 101 and the pressing roller 102.

The heating plate that is the contacting member 103 is a metal plate, or a plate formed of ceramic or polyimide resin, having a thickness of about 0.1 millimeter. The contacting member 103 is heated by radiation heat generated by the heating member 104. The contacting member 103 contacts the pressing roller 102 via the fixing film 101, thereby forming a desired nip portion between the fixing film 101 and the pressing roller 102.

The surface of the contacting member 103 that opposes the pressing roller 102 is generally flat. As a result, the nip portion is generally parallel to the image surface of a recording media P such as paper. As a result, the fixing film 101 and the recording media P make a firm contact with each other. With this configuration, the fixity of toner image is improved; moreover, curling and wrinkling of the recording media P when it passes through the nip portion can be suppressed. The curvature of the fixing film 101 on the exit side of the nip portion is greater. As a result, the recording media P sent out thereof can be easily separated from the fixing film 101.

Fluororesin is coated on the surface of the contacting member 103 in sliding contact with the fixing film 101. As a result, abrasion of the inner circumference of the fixing film 101, which is in sliding contact with the contacting member 103, can be reduced.

The infrared heater that is the heating member 104 is a heater having a heating source that emits infrared ray and a glass tube that accommodates the heating source therein. More specifically, the infrared heater includes a carbon heater or a halogen heater, and the both ends thereof are fixed to side panels (not shown) via the retaining member 106. Output power of the heating member 104 is controlled by a power supply unit (not shown) of an image forming apparatus (not shown). The heating member 104 heats the heat transfer member 105. The hot heat transfer member 105 heats the contacting member 103 that contacts the heat transfer member 105, and the hot contacting member 103 in turn heats the fixing film 101. Thus, the heat from the surface of the fixing film 101 is transferred to the toner image T on the recording media P. A control unit (not shown) performs output power control according to a sensing result of a surface temperature of the fixing film 101 performed by a temperature sensor (not shown) opposing the surface of the fixing film 101. By thus controlling output power of the infrared heater, a temperature of the fixing film 101, i.e., a fixing temperature, can be set to a desired temperature.

The infrared heater that is the heating member 104 is arranged in such a manner that the heating member 104 can be inserted into or pulled out from the fixing device while the contacting member 103 is in contact with the pressing roller 102 via the fixing film 101.

A ceramic heater can be used as the heating member 104. A carbon heater or a halogen heater is preferable as the heating member 104, because a carbon heater or a halogen heater has shorter starting time so that they can heat up more quickly than a ceramic heater. When a carbon heater is used, flexibility in on-off control is increased, compared with using a halogen heater. More specifically, even if power is repeatedly turned off before the duty of the heater reaches 100%, the heater is not burned out, as well as power reduction of the heater with time can be reduced.

When a carbon heater is used, the shape thereof can be preferably optimized so that the amount of radiation heat emitted by the carbon heater in the direction (the vertical direction in FIG. 1) toward the contacting member 103 can be more than the amount of radiation heat emitted thereby in the direction (the horizontal direction in FIG. 1) orthogonal to the vertical direction. As a result, heat generated by the heater can be intensively concentrated on the contacting member 103, thereby heating the contacting member 103 more efficiently.

An absorbent member that absorbs infrared ray may be provided on the surface of the contacting member 103 opposing the heating member 104. More specifically, the surface of the contacting member 103 opposing the heating member 104 may be painted black. As a result, infrared ray can be absorbed on the contacting member 103 more efficiently, and thus the contacting member 103 can be heated more efficiently.

The heat transfer member 105 is arranged such that the heat transfer member 105 surrounds the infrared heater that is the heating member 104 and contacts the contacting member 103. Therefore, the heat transfer member 105 can transfer the heat generated by the heating member 104 to the contacting member 103. The surface of the heat transfer member 105 contacting the contacting member 103 is configured such that the contacting surface is narrower than the surface of the nip portion. As a result, temperature of the nip portion can be raised efficiently.

Figure 2:
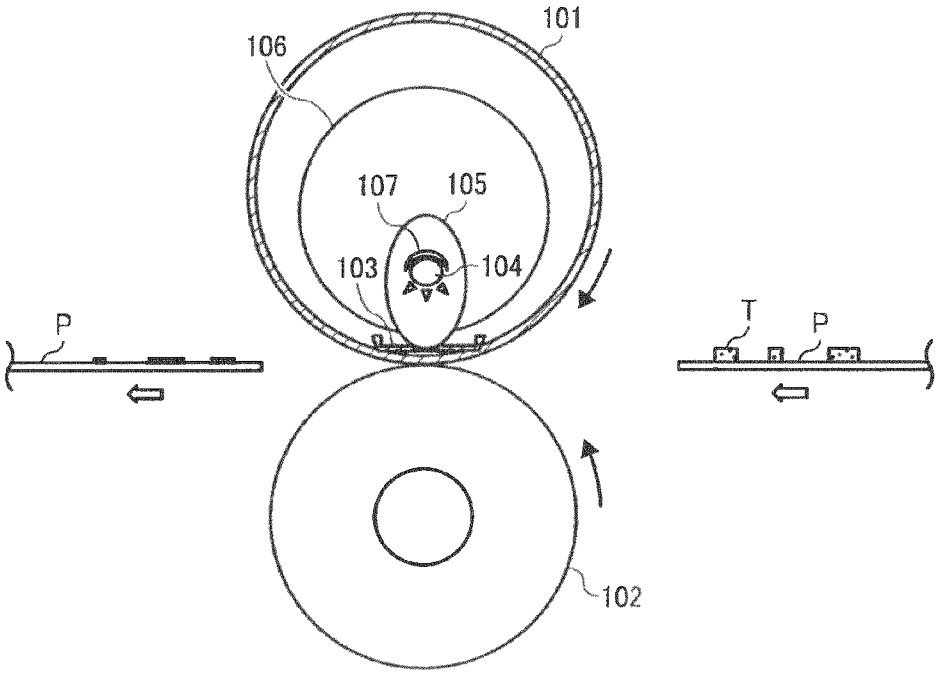
FIG. 2 is a schematic sectional view of a fixing device according to a second embodiment of the present invention.

FIG. 2 is a schematic sectional view of a fixing device according to a second embodiment of the present invention. The configuration of the fixing device according to the second embodiment is basically similar to that of the first embodiment shown in FIG. 1. In the present embodiment, however, a reflecting member 107 is provided on some portion of a glass tube included in the infrared heater that is the heating member 104. More specifically, on the other side of the surface of the glass tube opposing the contacting member 103, in which the surface of the glass tube is away from the nip portion, coating of reflecting material formed by electroplating process or aluminization is provided. The coating of reflecting material serves as the reflecting member 107. The reflecting member 107 concentrates infrared ray emitted from the heating member 104 on the surface on the side of the contacting member that is the surface closer to the nip portion, thereby heating the contacting member 103 more efficiently. As a result, heat can be more efficiently transferred to the nip portion.

Figure 3:
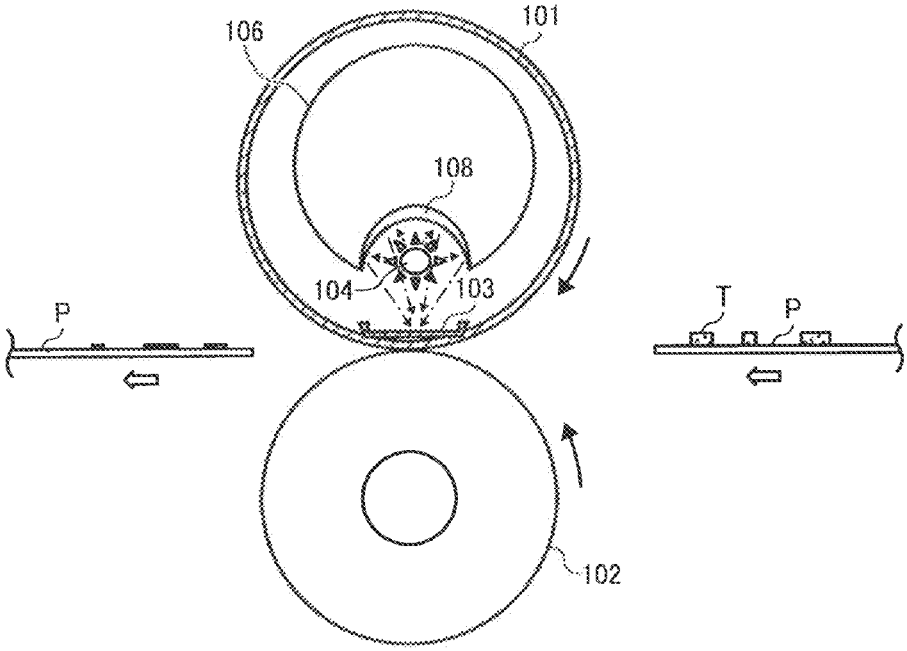
FIG. 3 is a schematic sectional view of a fixing device according to a third embodiment of the present invention.

FIG. 3 is a schematic sectional view of a fixing device according to a third embodiment of the present invention. The configuration of the fixing device according to the third embodiment is basically similar to that of the first embodiment shown in FIG. 1. In the third embodiment, however, a reflecting member 108 that reflects infrared ray emitted by the heating member 104 is provided instead of the heat transfer member 105 in the first embodiment. The reflecting member 108 concentrates infrared ray emitted therefrom on an area narrower than the width of the nip portion.

More specifically, a reflecting plate as the reflecting member 108 is arranged on the other side of the infrared heater that is the heating member 104 with respect to the contacting member 103. The reflecting member 108 reflects the infrared ray emitted by the heating member 104 and concentrates the infrared ray on the center of the nip portion of the contacting member 103, thereby heating the contacting member 103 intensively. As a result, heat is applied more efficiently to the contacting member 103, and thus heat is also applied to the recording media P more efficiently. Therefore, temperature of the recording media P can be quickly raised to a predetermined fixing temperature.

Figure 4:
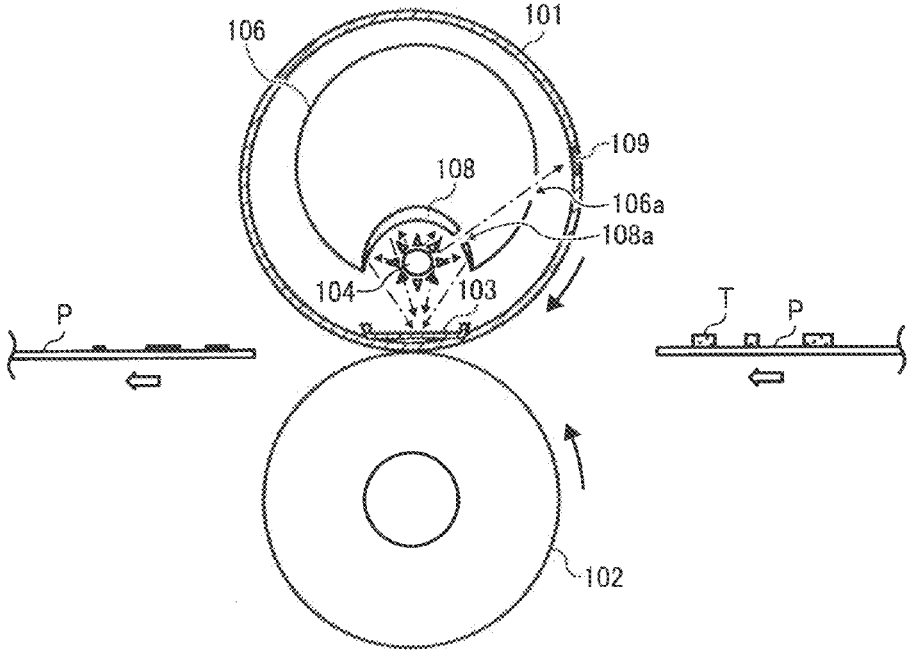
FIG. 4 is a schematic sectional view of a fixing device according to a fourth embodiment of the present invention.

FIG. 4 is a schematic sectional view of a fixing device according to a fourth embodiment of the present invention. The configuration of the fixing device according to the fourth embodiment is basically similar to that of the third embodiment shown in FIG. 3. In the present embodiment, however, the reflecting member 108 is provided with an aperture 108*a* and the retaining member 106 is provided with an aperture 106*a*. The infrared ray output by the heating member 104 pass through the apertures 108*a*, 106*a* and strikes on the reflecting member 108. Thus, the infrared ray strikes an area 109 of the fixing member 101. More specifically, the portion of the reflecting member 108 where the infrared ray strike is preferably located just upstream of the nip portion in the rotational direction of the fixing member. The temperature of the fixing member 101 can drop as it rotates. The infrared ray that strikes the fixing member 101 through the apertures 108*a* and 106*a* preheat the fixing member 101 before it enters the nip portion. As a result, time required to heat the fixing member 101 at the nip portion to a predetermined temperature can be reduced.

Thus, the reflecting member 108 is arranged such that the reflecting member 108 is placed over the heating member 104. An aperture, however, is provided on an area of the reflecting member 108, and thus areas of the fixing member 101 other than the nip portion can also be heated through the aperture 108*a* provided on the reflecting member 108 and the aperture area 106*a* provided on the retaining member 106. As a result, a time period for which temperature of the fixing member 101 is raised to a predetermined temperature can be reduced by heating the fixing member 101, which temperature is dropped while the fixing member is rotated.

Figure 5:
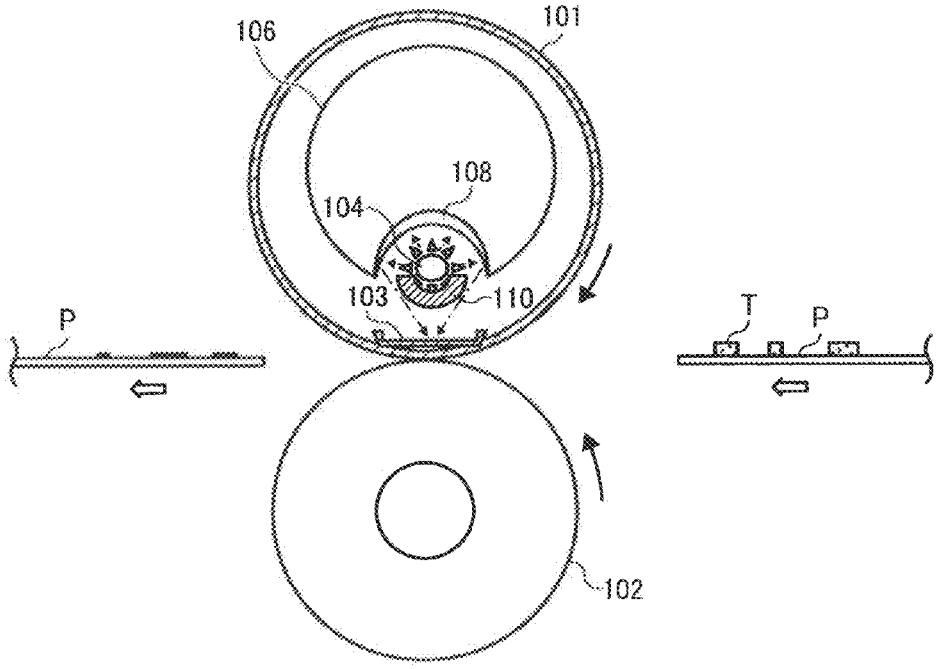
FIG. 5 is a schematic sectional view of a fixing device according to a fifth embodiment of the present invention.

FIG. 5 is a schematic sectional view of a fixing device according to a fifth embodiment of the present invention. The configuration of the fixing device according to the fifth embodiment is basically similar to that of the third embodiment shown in FIG. 3. In the present embodiment, however, a reflecting member is provided on either side of the heating member 104. Specifically, the reflecting member 108 is provided as a first reflecting member, and a reflecting member 110 is provided as a second reflecting member. The heating member 104 is provided between the reflecting members 108 and 110. Multiple reflection of the infrared ray output by the heating member 104 occurs due to the presence of two reflecting members. Therefore, the infrared ray are more efficiently concentrated on the contacting member 103, and the nip portion can be heated more by irradiation of infrared ray than by heat transfer from the vicinity of the heating member 104. The nip portion can be heated without being affected by atmospheric temperature or environment near the fixing device, temperature of the nip portion can be more quickly and more steadily raised, and thus temperature of the nip portion can be stabilized at a predetermined nip temperature.

Figure 6:
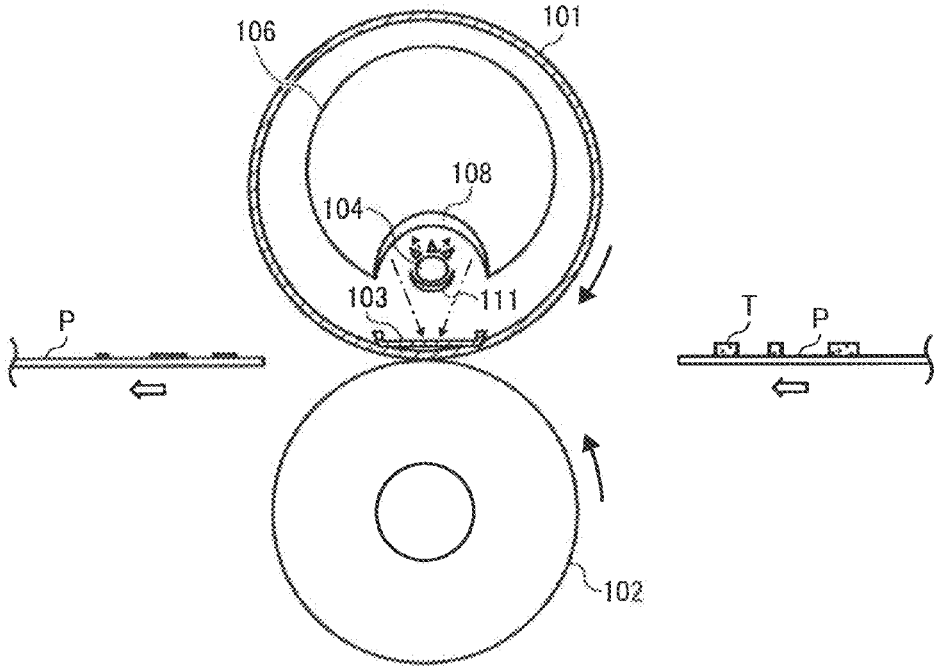
FIG. 6 is a schematic sectional view of a fixing device according to a sixth embodiment of the present invention.

FIG. 6 is a schematic sectional view of a fixing device according to a sixth embodiment of the present invention. The configuration of the fixing device according to the sixth embodiment is basically similar to that of the third embodiment shown in FIG. 3. In the present embodiment, however, a reflecting member 111 is provided on an area closer to the nip portion, which is an area opposing the contacting member, of the glass tube included in the infrared heater that is the heating member 104. The reflecting member 111 is formed by an electroplating process such as gold plating or aluminization. The reflecting member 111 serves as a second reflecting member. Therefore, infrared ray can be more efficiently emitted in the direction toward the reflecting member 108 that is the reflecting plate, and thus, infrared ray can be more efficiently reflected by the reflecting member 108. As a result, temperature of the nip portion can be raised more quickly and more steadily.

Figure 7:
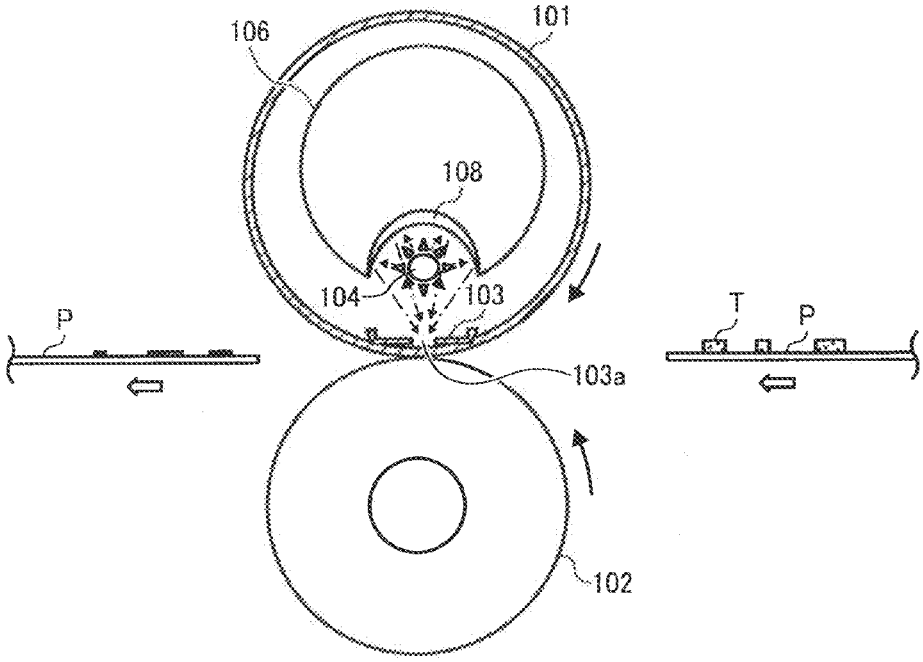
FIG. 7 is a schematic sectional view of a fixing device according to a seventh embodiment of the present invention.

FIG. 7 is a schematic sectional view of a fixing device according to a seventh embodiment of the present invention. The configuration of the fixing device according to the seventh embodiment is basically similar to that of the third embodiment shown in FIG. 3. In the present embodiment, however, an aperture 103*a* is provided in the contacting member 103. Infrared ray emitted by the heating member 104 and/or infrared ray reflected by the reflecting member 108 pass through the aperture 103*a* and strikes on the fixing member 101. As a result, the amount of heat absorbed by the contacting member 103 is reduced, and temperature of the nip portion can be raised more quickly and more steadily. Thus, a time period for which temperature of the nip portion is raised to a predetermined temperature can be shortened.

Figure 8:
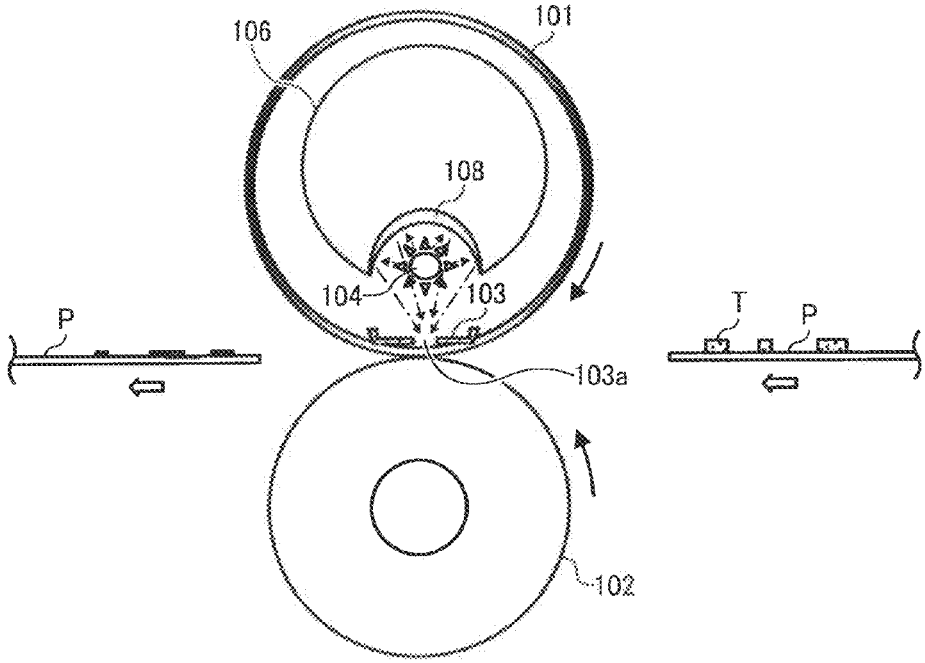
FIG. 8 is a schematic sectional view of a fixing device according to an eighth embodiment of the present invention.

FIG. 8 is a schematic sectional view of a fixing device according to an eighth embodiment of the present invention. The configuration of the fixing device according to the eighth embodiment is basically similar to that of the seventh embodiment shown in FIG. 7. In the present embodiment, however, the fixing member 101 is made of transparent material. The fixing member 101 is formed of transparent material through which infrared ray can pass, and thus, infrared ray emitted by the heating member 104 directly reaches the recording media P. Further, temperature of the nip portion can be raised more quickly and more steadily, and image can be fixed on the recording media P more quickly than in the seventh embodiment.

Figure 9:
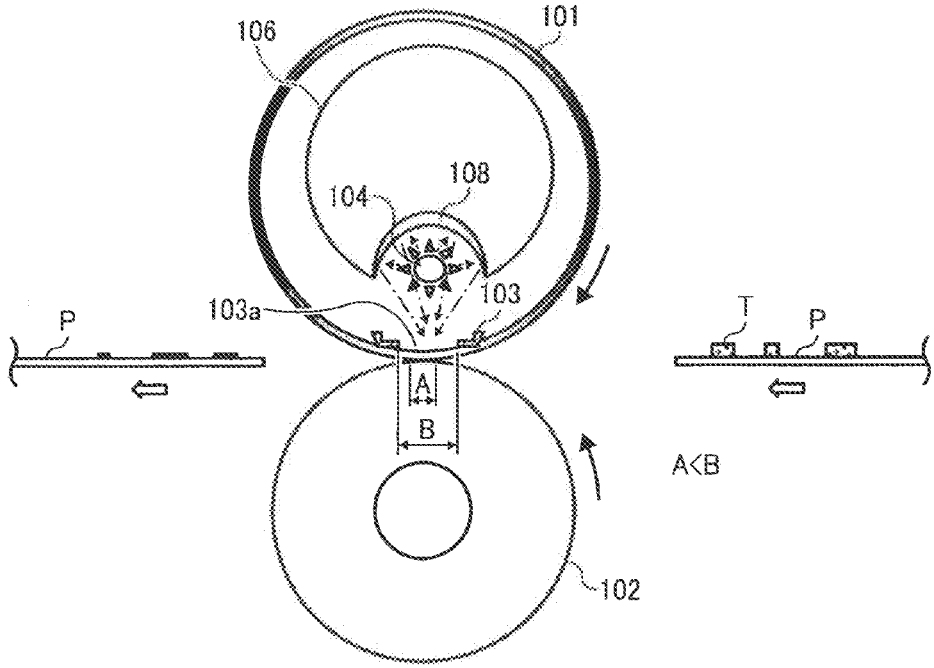
FIG. 9 is a schematic sectional view of a fixing device according to a ninth embodiment of the present invention.

FIG. 9 is a schematic sectional view of a fixing device according to a ninth embodiment of the present invention. The configuration of the fixing device according to the ninth embodiment is basically similar to that of the seventh embodiment shown in FIG. 7 or the eighth embodiment shown in FIG. 8. In the present embodiment, however, the aperture 103*a* in the contacting member 103 is wider, moreover, the contacting member 103 is arranged outer than the nip portion.

In the present embodiment, the width B of the aperture 103*a* is larger than the width A of the nip portion. Therefore, infrared ray emitted by the heating member 104 pass through the aperture 103*a* and strike on the recording medium P in the nip portion. Therefore, infrared ray are not emitted on the contacting member 103, and thus, the heat is not absorbed by the contacting member 103, and the infrared ray heat the nip portion efficiently. As a result, temperature of the whole of the nip portion can be raised more quickly.

Figure 10:
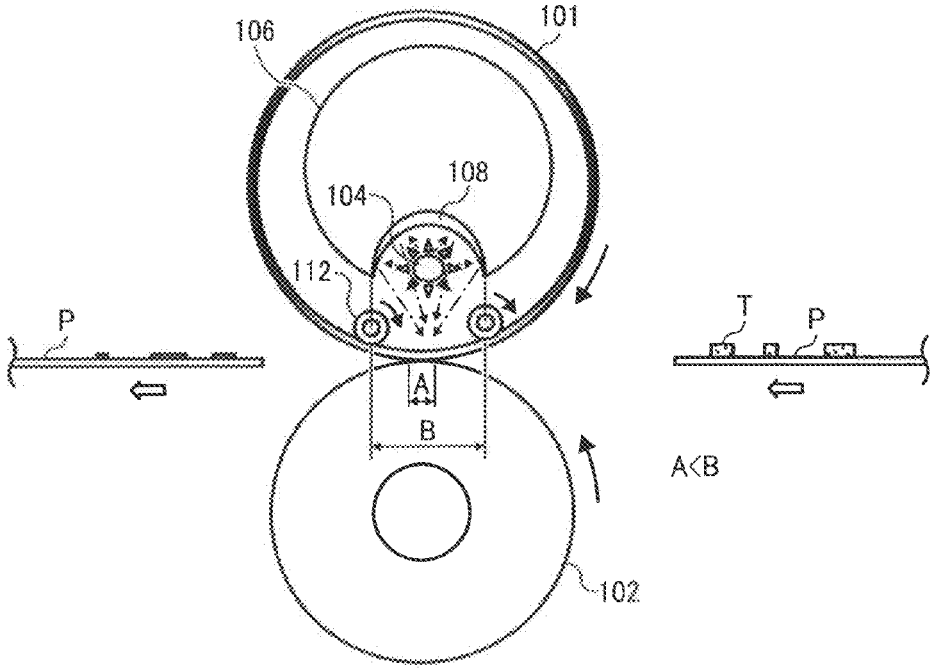
FIG. 10 is a schematic sectional view of a fixing device according to a tenth embodiment of the present invention.

FIG. 10 is a schematic sectional view of a fixing device according to a tenth embodiment of the present invention. The configuration of the fixing device according to the tenth embodiment is basically similar to that of the ninth embodiment shown in FIG. 9. In the present embodiment, however, a rotating contacting member 112 is each provided on a tip of the contacting member.

In the present embodiment, the rotating contacting members 112 are each provided on a tip of the contacting member, and thus, a contacting portion of the fixing member 101 can be the rotating contacting members 112. As a result, operating load that is rotating load of the fixing member 101 can be reduced, and the fixing member 101 can be steadily operated. The distance B between the rotating contacting members 112 is larger than the width A. As a result, infrared ray emitted by the heating member 104 heat the nip portion efficiently without being emitted on the contacting member and being absorbed thereinto. As a result, temperature of the whole of the nip portion can be raised more quickly.

Figure 11A:
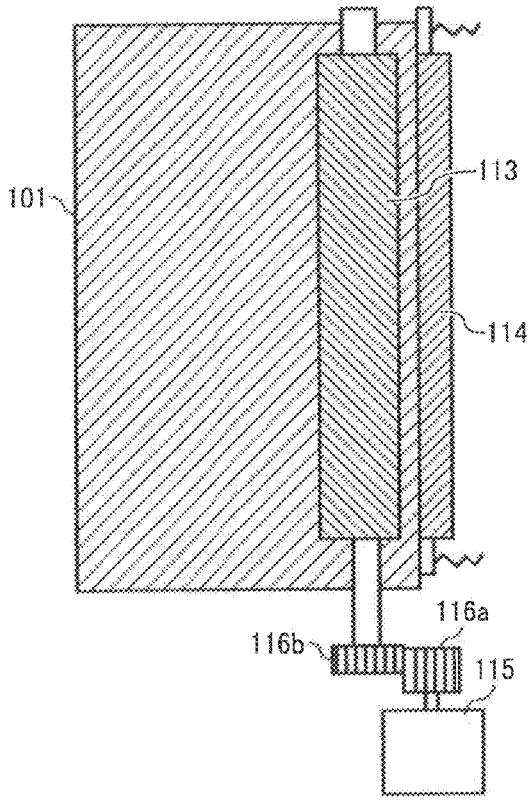
FIG. 11A is a plan view of a fixing device according to an eleventh embodiment of the present invention.
Figure 11B:
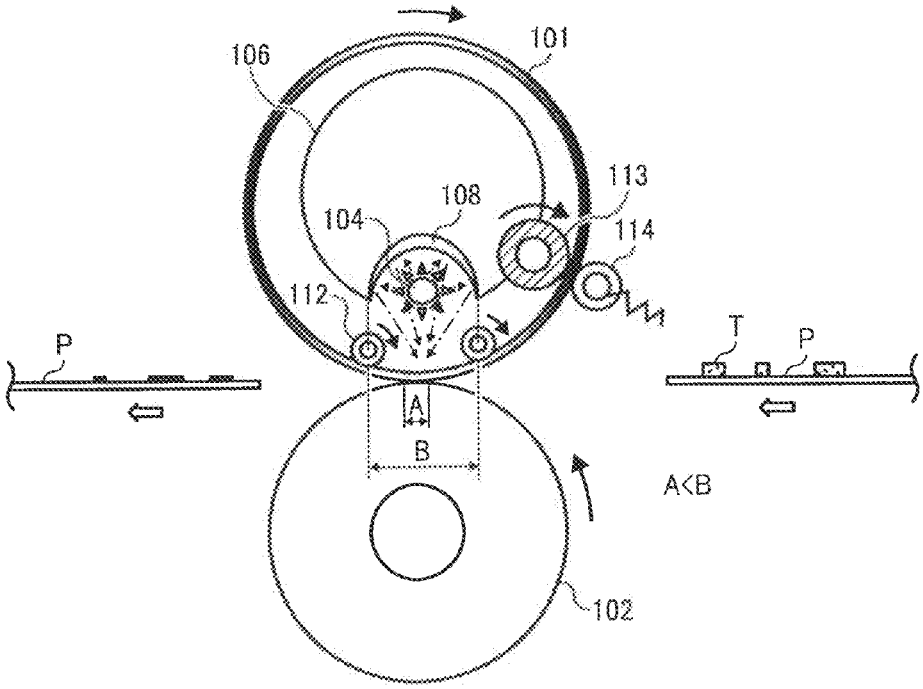
FIG. 11B is a schematic sectional view of the fixing device shown in FIG. 11B.

FIG. 11A is a plan view of a fixing device according to an eleventh embodiment of the present invention, and FIG. 11B is a schematic sectional view of the fixing device shown in FIG. 11B. The configuration of the fixing device according to the eleventh embodiment is basically similar to that of the tenth embodiment shown in FIG. 10. In the present embodiment, however, a pair of rotating members 113 and 114 that contact the fixing member 101 is provided, and the rotating member 113 is connected to a driving device 115, such as a driving motor, via gears 116*a* and 116*b*.

In the present embodiment, the rotating member 113 is provided in the interior of the fixing member 101, and the pressing rotating member 114 supported by a pressing unit such as a push spring is provided outside the fixing member 101. In other words, the fixing member 101 is sandwiched between the rotating member 113 and the pressing rotating member 114. The driving motor 115 drives the rotating member 113. The fixing member 101 rotates along with the rotating member 113. The positions of the rotating member 113 and the pressing rotating member 114 may be switched to each other.

By providing a pair of the rotating members 113 and 114 that contact the fixing member 101, connecting the rotating member 113 to the driving motor 115 via the gears 116*a* and 116*b*, and thus rotating the fixing member 101, the fixing member 101 can be rotated more stably than by allowing the fixing member 101 rotated due to friction resistance caused by the pressing member contacting the fixing member.

Figure 12A:
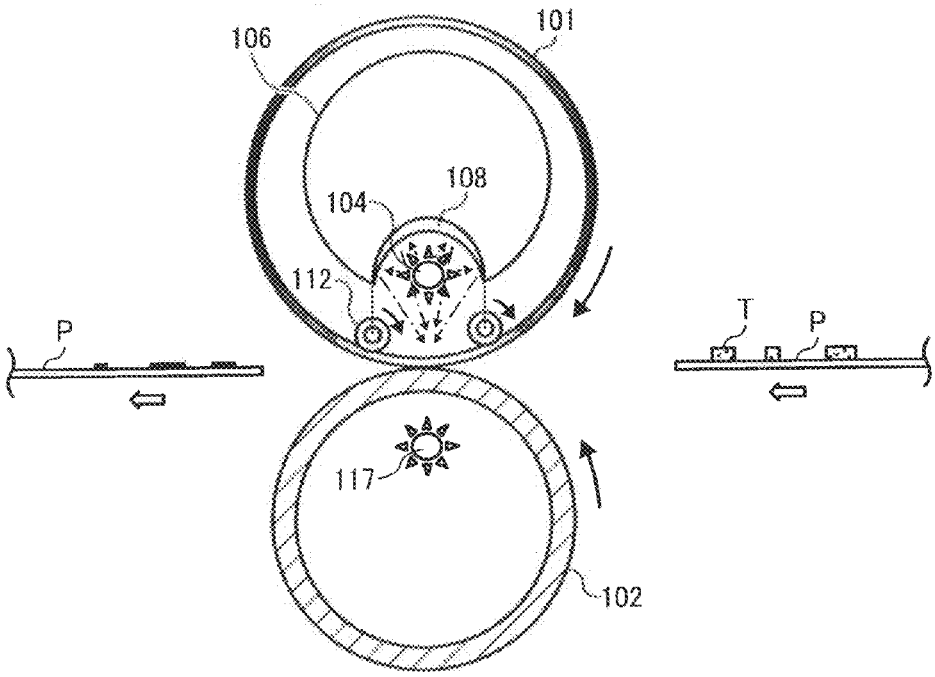
FIG. 12A is a schematic sectional view of a fixing device according to a twelfth embodiment of the present invention.
Figure 12B:
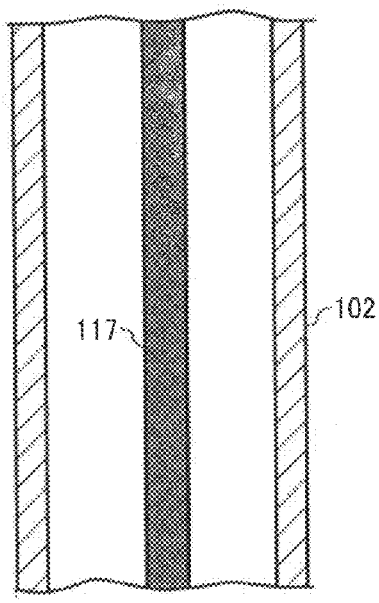
FIG. 12B is a schematic sectional view of a pressing member shown in FIG. 12A.

FIG. 12A is a schematic sectional view of a fixing device according to a twelfth embodiment of the present invention, and FIG. 12B is a schematic sectional view of a pressing member taken along a plane parallel to the shaft direction (main-scanning direction) of the pressing member. The configuration of the fixing device according to the twelfth embodiment is basically similar to that of the tenth embodiment shown in FIG. 10. In the present embodiment, however, the pressing member 102 is rigid.

In the present embodiment, the fixing member 101 is supported by a plurality of the rotating contacting members 112. Therefore, the nip portion of the fixing member 101 is resilient, and a nip portion can be formed although the pressing member 102 is formed of a rigid body. Because the pressing member 102 is rigid, it can be expected that durability of the pressing member 102 is improved.

In the present embodiment, because the pressing member 102 is rigid, a second heating member 117, such as an infrared heater, can be provided in the interior of the pressing member 102. As a result, a time period for which temperature of the nip portion is raised to a predetermined temperature can further be shortened.

Figure 13A:
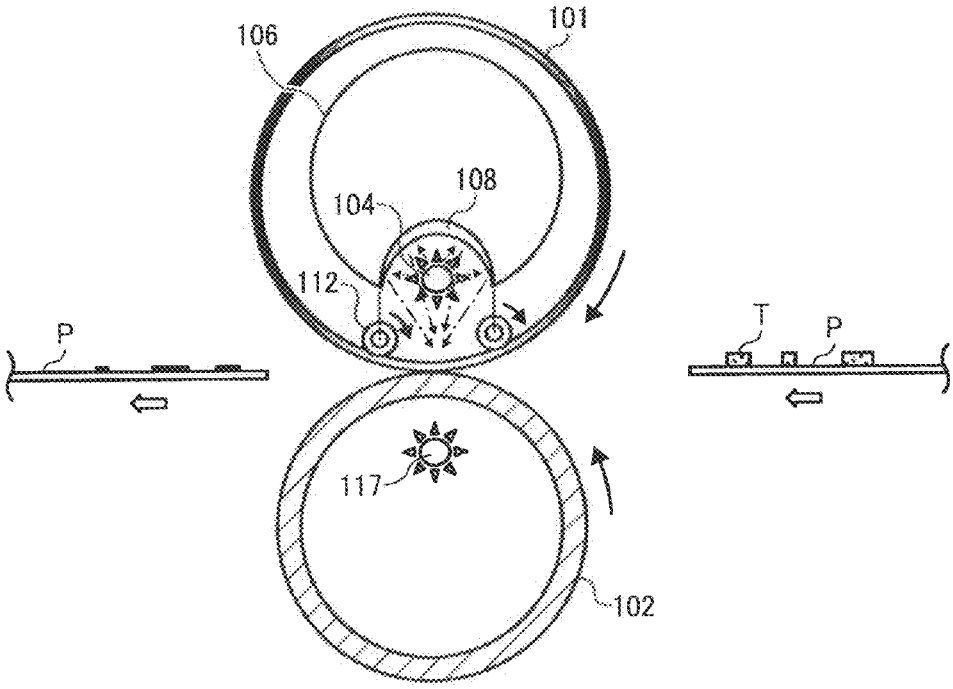
FIG. 13A is a schematic sectional view of a fixing device according to a thirteenth embodiment of the present invention.
Figure 13B:
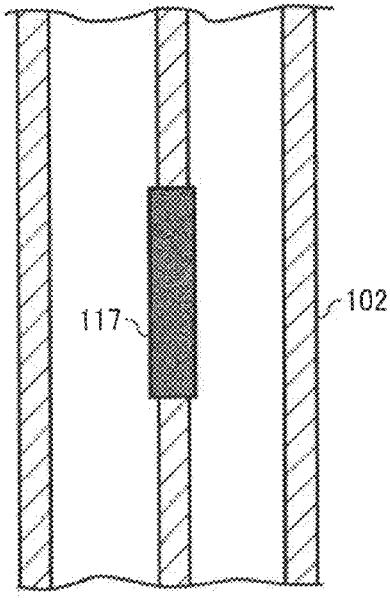
FIG. 13B is a schematic sectional view of a pressing member shown in FIG. 13A.

FIG. 13A is a schematic sectional view of a fixing device according to a thirteenth embodiment of the present invention, and FIG. 13B is a schematic sectional view of a pressing member shown in FIG. 13A taken along a plane parallel to the shaft direction (main-scanning direction) of the pressing member. The configuration of the fixing device according to the thirteenth embodiment is basically similar to that of the twelfth embodiment shown in FIG. 12. In the present embodiment, however, the second heating member 117 is provided in the main-scanning direction only in a middle section in the interior of the pressing member 102.

The pressing member 102 is formed of a hollow tube, and the second heating member 117 is provided in the interior thereof. The second heating member 117 is arranged in the main-scanning direction, and located only in a middle section in the interior of the pressing member 102. Fixing temperature of recording media P having various widths in the main-scanning direction can be steadily controlled. More specifically, the second heating member is provided in the main-scanning direction only in a middle section in the interior of the pressing member 102, and operation of the second heating member is controlled so that the second heating member is not used if a width of the recording media in the main-scanning direction is larger, and the second heating member is used if a width of the recording media in the main-scanning direction is smaller. Thus, heat can be steadily supplied to recording media having various width in the main-scanning direction, as well as temperature rise of the ends of the fixing member can be suppressed if sheets of recording media of which size in the main-scanning direction is smaller are conveyed continuously through the nip portion.

If sheets of smaller paper are conveyed continuously through the nip portion, temperature of the heating member 104 provided in the interior of the fixing member 101 is set to be lower, and a fixing temperature of the nip portion is assisted by heating performed by the second heating member 117. Thus, temperature rise of the ends of the fixing member can be reduced while sheets of smaller paper are conveyed continuously through the nip portion. If sheets of larger size paper are conveyed continuously therebetween, heating performed by the second heating member 117 is suspended and only the heating member 104 is used to perform heating. Thus, the fixing member 101 is uniformly heated thereacross in the main-scanning direction.

Embodiments of the fixing device of the present invention are described above. Exemplary embodiments of an image forming apparatus including the fixing device are described below in greater detail.

Figure 14:
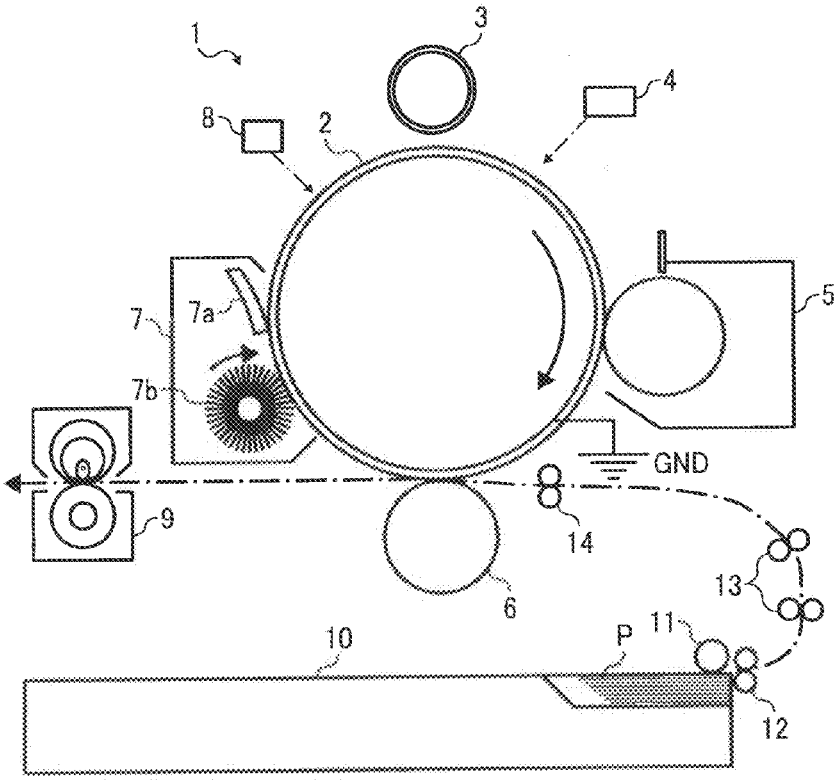
FIG. 14 is a schematic of an image forming apparatus according to a fourteenth embodiment of the present invention.

FIG. 14 is a schematic of an image forming apparatus 1 according to a fourteenth embodiment of the present invention. In the image forming apparatus 1, a photosensitive element 2 that serves as an image carrier is housed in a body housing (not shown), and the photosensitive element 2 is rotated clockwise that is the direction of the arrow shown in FIG. 2. Around the photosensitive element 2, various components such as an electrifying unit 3, a writing unit 4, a developing unit 5, a paper transfer unit 6, a paper separating unit, a cleaning unit 7, and a diselectrifying unit 8 are arranged.

The electrifying unit 3 includes electrifying devices such as an electrifying roller, and an electrifying brush, an electrifying charger. A power supply (not shown) in a voltage applying unit applies a predetermined voltage to the electrifying unit 3, and the electrifying unit 3 electrifies the surface of the photosensitive element 2 uniformly.

The writing unit 4 includes a writing device using a laser scanning method including a laser light source, a coupling optical system (such as a collimating lens, an aperture, a cylindrical lens), a light deflector (such as polygon mirror, a pyramidal mirror, and a vibrating mirror), a scan image-forming optical system (a scanning lens, for example, a fθ lens, a field curvature corrective lens, an anastigmat lens, and a mirror), and scans over the photosensitive element 2 by using laser light to obtain image data, and thus forms an electrostatic latent image according to the image data. A line-shaped optical writing device including an LED (light emitting diode) array and an equimultiple image forming optical system can be used as the writing unit 4, instead of the laser scanning method.

The developing unit 5 includes a developing device using either a monocomponent development method in which only toner is used as developer or a two-component development method in which toner and carrier are used as developer. The developing unit 5 develops and visualizes an electrostatic latent image formed on the photosensitive element.

The paper transfer unit 6 includes transfer devices such as a transfer roller, a transfer brush, and a transfer charger. A power supply (not shown) in a voltage applying unit applies a predetermined transfer bias to the paper transfer unit 6. Thus, the paper transfer unit 6 transfers a toner image formed on the photosensitive element to recording media, for example, recording paper P.

The paper separating unit (not shown) optionally includes components such as a paper separating hook, a diselectrifying charger, a diselectrifying needle so that recording paper can be easily separated from the photosensitive element 2.

The cleaning unit 7 includes a cleaning device using a blade and a fur brush, and cleans off residual transfer toner left on the photosensitive element.

The diselectrifying unit 8 includes diselectrifying devices such as a lamp, an ELD, and a diselectrifying charger, and removes residual charge left on the photosensitive element.

The image forming apparatus 1 further includes a paper feeding cassette 10 that accommodates a plurality of sheets of recording paper P. The paper feeding cassette 10 can hold only one tray, or can hold a plurality of trays. Sheets of the recording paper P accommodated in the paper feeding cassette 10 are fed one by one by a paper feeding roller 11 and a pair of separation rollers 12, and are conveyed to a pair of registration rollers 14 via conveying rollers 13. After timing adjustment is performed at the pair of registration rollers 14, the recording paper P is conveyed to a space between the paper transfer unit 6 and the photosensitive element 2.

A fixing unit 9 and a paper ejection tray (not shown) are provided downstream of the paper transfer unit 6 in the direction to which the recording paper is conveyed.

The image forming apparatus 1 includes a control unit that controls the various devices described above. The control unit includes a CPU (central processing unit) including a microprocessor unit; various memories such as a ROM, a RAM, and a non-volatile RAM; an input/output device such as I/O ports and various interfaces; various control circuits; a clock; a timer; and a counter. The control unit is not shown.

Operation of the image forming apparatus 1 is described in greater detail. The image forming apparatus 1 rotates the photosensitive element 2 clockwise, that is, in the direction shown by the arrow shown in FIG. 14 and electrifies the photosensitive element 2 uniformly at the electrifying unit 3; irradiates the photosensitive element 2 with laser light modulated according to image data by the writing unit 4 and forms an electrostatic latent image on the photosensitive element 2; attaches toner at the developing unit 5 to the photosensitive element 2 on which the electrostatic latent image formed; and thus develops and forms a visible image that is a toner image. The image forming apparatus 1 transfers a toner image on the photosensitive element 2, on which the toner image is formed by the developing unit 5, on the recording paper P that is conveyed to the nip portion between the photosensitive element 2 and the paper transfer unit 6 by the paper transfer unit 6, and conveys the recording paper P on which the toner image is transferred to the fixing unit 9. The fixing unit 9 includes a fixing device that is any of the fixing devices described in the first to thirteenth embodiments. The fixing unit 9 heats and presses the recording paper P that is conveyed from the paper transfer unit 6, fixes the toner image formed on the recording paper P to the recording paper P, and then ejects the recording paper P to the paper ejection tray (not shown).

The image forming apparatus 1 further rotates the photosensitive element 2 from a position where the toner image is transferred by the paper transfer unit 6 to the recording paper P, removes residual toner left on the surface of the photosensitive element 2 by scraping off the residual toner with a cleaning blade 7*a* at the cleaning unit 7, and then diselectrifies the photosensitive element 2 by the diselectrifying unit 8. The image forming apparatus 1 electrifies the photosensitive element 2 that is diselectrified by the diselectrifying unit 8, and then similarly performs a next image forming operation.

The cleaning unit 7 is not limited to a configuration in which the cleaning blade 7*a* scrapes off residual toner left on the photosensitive element 2. The cleaning unit 7 may also be configured so that a fur brush 7*b* scrapes off residual toner left thereon.

In the image forming apparatus 1 according to the present embodiment, the fixing unit 9 includes a fixing device according to any one of the first to thirteenth embodiments. Therefore, it is expected that a starting time can be shortened, energy saving feature can be achieved, and toner fixity can be improved.

Figure 15:
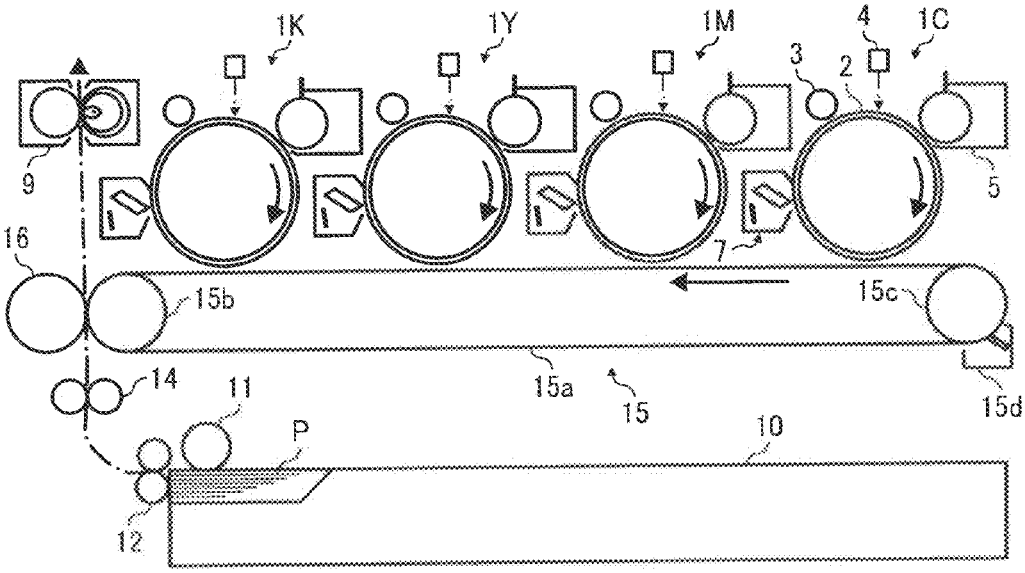
FIG. 15 is a schematic of an image forming apparatus according to a fifteenth embodiment of the present invention.

FIG. 15 is a schematic of an image forming apparatus according to a fifteenth embodiment of the present invention. The image forming apparatus according to the present embodiment is a tandem type full-color image forming apparatus.

The image forming apparatus shown in FIG. 15 includes four image forming units 1C, 1M, 1Y, and 1K along an intermediate transfer unit 15. Each of the image forming units 1C, 1M, 1Y, and 1K forms image having a specific color, Cyan, Magenta, Yellow, and Back respectively. The configuration of each image forming unit, however, is the same. In each image forming unit 1C, 1M, 1Y, and 1K, the configuration around the photosensitive element is generally similar to that of the image forming apparatus 1 shown in FIG. 14.

More specifically, for example, in the image forming unit 1C, the photosensitive element 2 that serves as an image carrier is accommodated within a housing (not shown) such as a cartridge, and the photosensitive element 2 is rotated clockwise, that is, in the direction of the arrow shown in the FIG. 15. Around the photosensitive element 2, operating units such as the electrifying unit 3, the writing unit 4, the developing unit 5, the intermediate transfer unit 15, the cleaning unit 7, and the diselectrifying unit (not shown) are arranged.

The configurations of the electrifying unit 3, the writing unit 4, the developing unit 5, the cleaning unit 7, and the diselectrifying unit are similar to that of the image forming apparatus shown in FIG. 14.

In each of the image forming units 1C, 1M, 1Y, and 1K, operating units such as the photosensitive element 2, the developing unit 5, the electrifying unit 3, and the cleaning unit 7 may be integrally included within a cartridge (not shown), thereby forming a process cartridge. Then, the process cartridge is detachably attached to the image forming apparatus, and maintenance and replacement of the image forming units 1C, 1M, 1Y, and 1K are easier.

The intermediate transfer unit 15 includes an intermediate transfer body (intermediate transfer belt) 15*a* that is in the shape of an endless belt and is extended between a plurality of rollers including a drive roller 15*b* and a follower roller 15*c*, and primary transfer units (not shown) of which each is arranged to oppose each of the photosensitive elements respectively on the back surface of the intermediate transfer belt. A toner image formed on the photosensitive element of each of the image forming units 1C, 1M, 1Y, and 1K is transferred to the intermediate transfer belt 15*a* sequentially.

The image forming apparatus further includes a paper feeding cassette 10 that accommodates a plurality of sheets of recording paper P. In FIG. 15, the paper feeding cassette 10 holds only one tray. The paper feeding cassette 10, however, may hold a plurality of trays optionally. Sheets of the recording paper P accommodated in the paper feeding cassette 10 are fed one by one by the paper feeding roller 11 and the separation rollers 12, and are conveyed to the registration rollers 14. After timing adjustment is performed at the registration rollers 14, the recording paper P is conveyed to a space between the intermediate transfer belt 15*a* included in the intermediate transfer unit 15 and a paper transfer unit 16.

The fixing unit 9 and a paper ejection tray (not shown) are provided downstream of the paper transfer unit 16 in the direction to which the recording paper is conveyed.

The image forming apparatus shown in FIG. 15 includes a control unit that controls the various devices described above. The control unit includes a CPU (central processing unit) including a microprocessor unit; various memories such as a ROM, a RAM, and a non-volatile RAM; an input/output device such as I/O ports and various interfaces; various control circuits; a clock; a timer; and a counter. The control unit is not shown.

Operation of the image forming apparatus is described below in greater detail. Each of the image forming units 1C, 1M, 1Y, and 1K included in the full-color image forming apparatus rotates the photosensitive element 2 clockwise, that is, in the direction shown by the arrow shown in FIG. 15 and electrifies the photosensitive element 2 uniformly at the electrifying unit 3; irradiates the photosensitive element 2 with laser light modulated according to image data by the writing unit 4 and forms an electrostatic latent image on the photosensitive element 2; attaches toner having a specific color according to each image forming unit to the photosensitive element 2 on which the electrostatic latent image is formed; and thus, at the developing unit, develops and forms a visible image that is a toner image. Each of the image forming units 1C, 1M, 1Y, and 1K attaches a specific color according to each image forming unit to the photosensitive element 2 by the developing unit 5, and thus forms a toner image, and transfers the toner image from the photosensitive element 2 to the intermediate transfer belt 15*a* at the intermediate transfer unit 15. The procedure is performed in the order of C, Y, Y, and K. Thus, a colored toner image that is formed by superimposing four colors is formed on the intermediate transfer belt.

The colored toner image formed on the intermediate transfer belt is transferred on the recording paper P that is conveyed by the paper transfer unit 16 to a space between the intermediate transfer belt 15*a* and the paper transfer unit 16, and the recording paper P on which the toner image is transferred is conveyed to the fixing unit 9. The fixing unit 9 that includes a fixing device according to any one of the first to thirteenth embodiments applies heat and pressure to the recording paper P that is conveyed from the paper transfer unit 16, fixes the toner image formed on the recording paper to the recording paper P, and then ejects the recording paper P on a paper ejection tray (not shown).

Each of the image forming units 1C, 1M, 1Y, and 1K further rotates the photosensitive element 2 from a position where the toner image is transferred by the intermediate transfer unit 15 on the recording paper P, removes residual toner left on the surface of the photosensitive element by scraping off the residual toner with a component such as a cleaning blade at the cleaning unit 7, and then diselectrifies the photosensitive element 2 by a photosensitive element diselectrifying unit (not shown). Then each image forming unit prepares for a next image forming operation. Residual toner left on the intermediate transfer belt 15*a* on which toner image is transferred by the paper transfer unit 16 is removed by a belt cleaning unit 15*d*, by scraping off residual toner.

In the image forming apparatus according to the present embodiment, the fixing unit 9 includes a fixing device according to any one of the first to thirteenth embodiments. Therefore, it is expected that a starting time can be shortened, energy saving feature can be achieved, and toner fixity can be improved.

Figure 16:
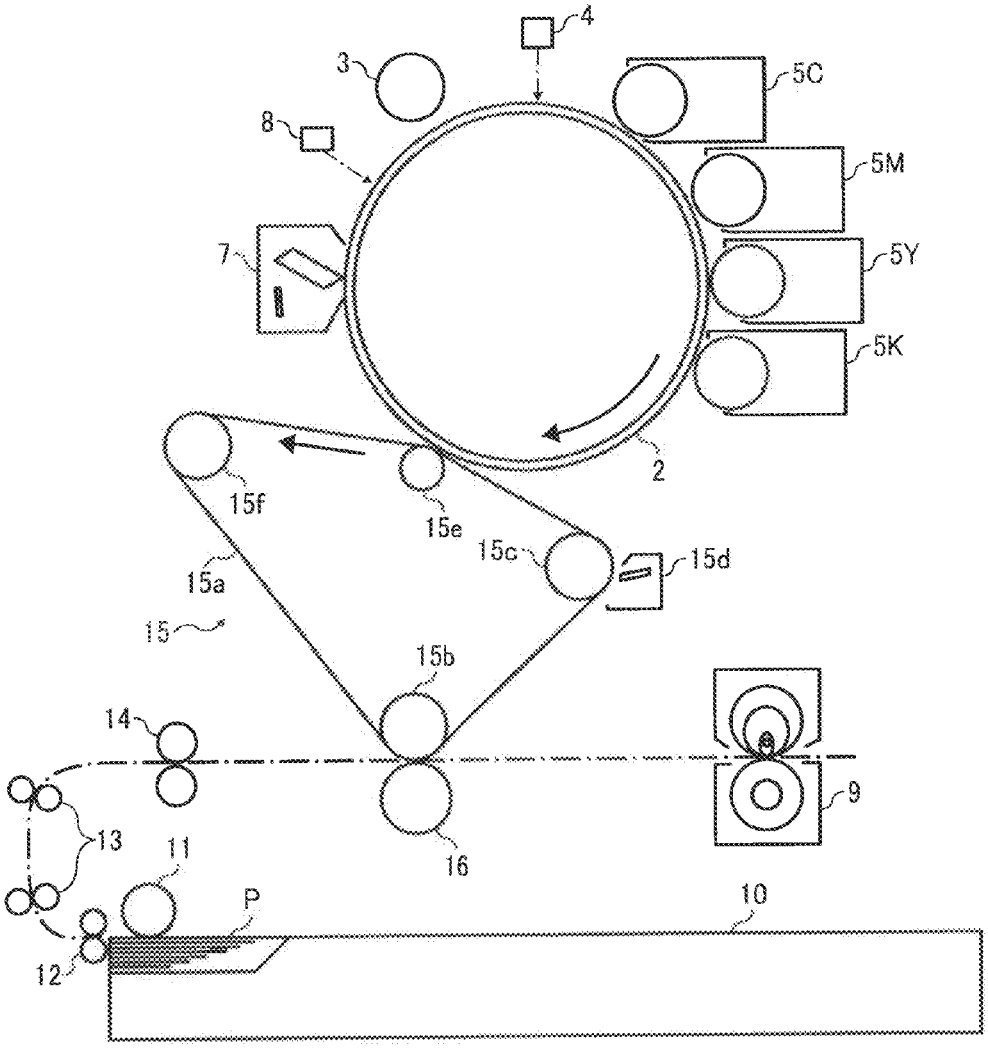
FIG. 16 is a schematic of an image forming apparatus according to a sixteenth embodiment of the present invention.

FIG. 16 is a schematic of an image forming apparatus according to a sixteenth embodiment of the present invention. The image forming apparatus according to the present embodiment is a revolver type full-color image forming apparatus.

The image forming apparatus shown in FIG. 16 includes one photosensitive element 2 that serves as an image carrier, a plurality of developing devices 5C, 5M, 5Y, and 5K having different developing colors, and the intermediate transfer unit 15. More specifically, around the photosensitive element 2, operating units such as the electrifying unit 3, the writing unit 4, a developing unit including the developing devices 5C, 5M, 5Y, and 5K, the intermediate transfer unit 15, the cleaning unit 7, and the diselectrifying unit 8 are arranged.

The configurations of the electrifying unit 3, the writing unit 4, the cleaning unit 7, and the diselectrifying unit 8 are similar to that of the image forming apparatus 1 shown in FIG. 1.

The developing devices 5C, 5M, 5Y, and 5K having different developing colors are detachably attached to the photosensitive element 2. By switching the operation of the developing devices 5C, 5M, 5Y, and 5K, developing is performed color by color, according to each developing device.

The intermediate transfer unit 15 includes the intermediate transfer body 15*a* that is in the shape of an endless belt and is extended between a plurality of rollers including the drive roller 15*b* and the follower rollers 15*c* and 15*f*, and a primary transfer unit (for example, a primary transfer roller) 15*e* that is arranged to oppose the photosensitive element on the back surface of the intermediate transfer belt. Toner images having various colors formed on photosensitive element are sequentially transferred on the intermediate transfer belt 15*a*.

More specifically, in the image forming apparatus shown in FIG. 16, an electrostatic latent image formed on the photosensitive element is developed by one developing device, thereby forming a visible image. A step in which the visible image is transferred on the intermediate transfer body 15*a* (intermediate transfer belt) included in the intermediate transfer unit 15 is sequentially performed by switching the operation of the developing devices 5C, 5M, 5Y, and 5K. While the photosensitive element and the intermediate transfer belt rotate four times, a multi-color or full-color image is formed on the intermediate transfer belt 15*a* by superimposing colors C, M, Y, and K.

The image forming apparatus shown in FIG. 16 further includes the paper feeding cassette 10. In FIG. 16, the paper feeding cassette holds only one tray. The paper feeding cassette 10, however, may hold a plurality of trays therein. Sheets of the recording paper P accommodated in the paper feeding cassette 10 are fed one by one by the paper feeding roller 11 and the pair of separation rollers 12 via the conveying roller 13, and are conveyed to the pair of registration rollers 14. After timing adjustment is performed at the pair of registration rollers 14, the recording paper P is conveyed to a space between the intermediate transfer belt 15*a* included in the intermediate transfer unit 15 and the paper transfer unit 16.

The color toner image formed on the intermediate transfer belt is transferred by the paper transfer unit 16 on the recording paper P that is conveyed to a space between the intermediate transfer belt 15*a* and the paper transfer unit 16, and the recording paper P on which the toner image is transferred is conveyed to the fixing unit 9. The fixing unit 9 that includes a fixing device according to any one of the first to thirteenth embodiments applies heat and pressure to the recording paper P that is conveyed from the paper transfer unit 16, fixes the toner image formed on the recording paper to the recording paper P, and then ejects the recording paper P on a paper ejection tray (not shown).

The image forming unit further rotates the photosensitive element 2 from a position where the toner image is transferred by the intermediate transfer unit 15 to the intermediate transfer belt 15*a*, removes residual toner left on the surface of the photosensitive element 2 by scraping off the residual toner by a cleaning blade and the like in the cleaning unit 7, diselectrifies the photosensitive element 2 by the diselectrifying unit 8, and then perform a next image forming operation. Residual toner left on the intermediate transfer belt 15*a* on which toner image is transferred by the paper transfer unit 16 is removed by the belt cleaning unit 15*d*, by scraping off residual toner. The belt cleaning unit 15*d* is in standby being separated from the belt during a primary transfer step in which a toner image having each of the colors is sequentially transferred from the photosensitive element 2 to the intermediate transfer belt 15*a* that is a time period while the intermediate transfer belt rotates four times. Instantly after the toner image is transferred on the recording paper P by the paper transfer unit 16, the belt cleaning unit 15*d* contacts the surface of the intermediate transfer belt 15*a* and cleans the surface thereof.

The cleaning units 7 or 15*d* is not limited to a configuration in which residual toner left on the photosensitive element or the intermediate transfer belt is scraped off by a blade. The cleaning units 7 or 15*d* may, however, be configured so that residual toner is scraped off by a fur brush.

The image forming apparatus shown in FIG. 16 also includes a control unit that controls the various devices described above. The control unit includes a CPU including a microprocessor unit; various memories such as a ROM, a RAM, and a non-volatile RAM; an input/output device such as I/O ports and various interfaces; various control circuits; a clock; a timer; and a counter. The control unit is not shown.

In the image forming apparatus according to the present embodiment, the fixing unit 9 includes a fixing device according to any one of the first to thirteenth embodiments. Therefore, it is expected that a starting time can be shortened, energy saving feature can be achieved, and toner fixity can be improved.

According to an aspect of the present invention, infrared ray is emitted so that the infrared ray is concentrated on an area narrower than a width of a nip portion. Therefore, heat can be efficiently supplied to recording media and temperature can be quickly raised to a predetermined fixing temperature.

According to another aspect of the present invention, infrared ray can be efficiently concentrated into a nip portion. Therefore, heat can be efficiently transferred to the nip portion.

According to still another aspect of the present invention, areas of a fixing member other than a nip portion can be heated through an aperture area formed on a reflecting member. Therefore, a time period for which temperature of a fixing member is raised to a predetermined temperature can be reduced by heating the fixing member that is cooled while the fixing member is rotated.

According to still another aspect of the present invention, heat generated by infrared ray can be emitted toward a reflecting member, thereby concentrating infrared ray more efficiently. As a result, temperature at the nip portion can be raised more quickly and more steadily.

According to still another aspect of the present invention, amount of heat transferred to a contacting member can be reduced, and thus temperature at the nip portion can be raised more quickly and more steadily.

According to still another aspect of the present invention, infrared ray emitted by a heating member directly reaches a recording media, and temperature at the nip portion can be raised more quickly and more steadily.

According to still another aspect of the present invention, rotation load of a fixing member can be reduced, and the fixing member can be operated more steadily.

According to still another aspect of the present invention, by rotating a rotating member contacting a fixing member, the fixing member can also be rotated. Thus, the fixing member can be more steadily rotated than by allowing the fixing member rotated due to friction resistance caused by a pressing member contacting the fixing member.

According to still another aspect of the present invention, durability of a pressing member can be expected to be increased.

According to still another aspect of the present invention, heat can be supplied steadily to recording media having various sizes in the main-scanning direction by controlling operation of a second heating member so that the second heating member is not used if a size of recording media in the main-scanning direction is larger and the second heating member is used if a size of recording media in the main-scanning direction is smaller. In addition, temperature rise of the ends of the fixing member can be suppressed if sheets of recording paper of which size in the main-scanning direction is smaller are continuously conveyed through a nip portion.

According to still another aspect of the present invention, a fixing device can be provided in which a starting time thereof is short, a structure thereof is relatively simple, and a heating unit can be replaced efficiently.

According to still another aspect of the present invention, a fixing device can be provided of which a starting time can be reduced, of which energy saving feature is achieved, and of which toner fixity is enhanced.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device for fixing an unfixed image formed on a recording medium, comprising:

a fixing member that is flexible;

a pressing member, exterior to the fixing member, that is in pressure contact with the fixing member;

a contacting member in an interior of the fixing member which contacts the fixing member and is stationary relative to the fixing member;

a heater that emits infrared rays; and a heat transfer member which receives the infrared rays from the heater, is heated by the heater, and transfers heat from the infrared rays to the contacting member, and a perimeter of a cross-section of the heat transfer member surrounding the heater and having only curved lines, wherein:

the contacting member is in contact with the pressing member via the fixing member, the contacting member transfers heat from the heat transfer member to the fixing member, the contacting member and the pressing member sandwich the fixing member thereby forming a nip portion, and during a fixing operation, the contacting member is stationary relative to the fixing member.

2. The fixing device according to claim 1, wherein:

the contacting member comprises a ceramic or resin.

3. The fixing device according to claim 1, wherein:

the contacting member comprises metal.

4. The fixing device according to claim 1, wherein:

the heat transfer member comprises a surface which is parallel to a line between the heater and an axis of the pressing member.

5. The fixing device according to claim 4, wherein:

a surface of the heat transfer member contacting the pressing member through the fixing member is narrower than a surface of the nip portion.

6. The fixing device according to claim 1, wherein:

heat is transferred from the heat transfer member to the contacting member due to contact between the heat transfer member and the contacting member.

7. An image forming apparatus comprising the fixing device of claim 1.

8. A fixing device for fixing an unfixed image formed on a recording medium, comprising:

a fixing member that is flexible;

a pressing member, exterior to the fixing member, that is in pressure contact with the fixing member;

a contacting member in an interior of the fixing member which contacts the fixing member;

a heater that emits infrared rays; and a heat transfer member which receives the infrared rays from the heater, is heated by the heater, and transfers heat from the infrared rays to the contacting member, and a perimeter of a cross-section of the heat transfer member surrounding the heater and having only curved lines, wherein:

the contacting member is in sliding contact with the pressing member via the fixing member, the contacting member transfers heat from the heat transfer member to the fixing member, and the contacting member and the pressing member sandwich the fixing member thereby forming a nip portion.

9. The fixing device according to claim 8, wherein:

the contacting member is coated with Fluororesin on a surface thereof which is in sliding contact with the fixing member.

10. The fixing device according to claim 8, wherein:

the contacting member comprises a heating plate.

11. The fixing device according to claim 10, wherein:

the heating plate is generally flat.

12. The fixing device according to claim 8, further comprising:

a retaining member that retains the heating member and the heat transfer member.

13. The fixing device according to claim 12, wherein:

the retaining member is inside of a loop of the fixing member.

14. An image forming apparatus comprising the fixing device of claim 8.

* * * * *